US012158309B2

(12) United States Patent
Liu et al.

(10) Patent No.: US 12,158,309 B2
(45) Date of Patent: Dec. 3, 2024

(54) HEAT PIPE WITH COMPOSITE WICK STRUCTURE

(71) Applicant: VAST GLORY ELECTRONICS & HARDWARE & PLASTIC(HUI ZHOU) LTD., Hui Zhou (CN)

(72) Inventors: Lei Lei Liu, Hui Zhou (CN); Xue Mei Wang, Hui Zhou (CN)

(73) Assignee: VAST GLORY ELECTRONICS & HARDWARE & PLASTIC(HUI ZHOU) LTD., Hui Zhou (CN)

( * ) Notice: Subject to any disclaimer, the term of this patent is extended or adjusted under 35 U.S.C. 154(b) by 32 days.

(21) Appl. No.: 17/164,398

(22) Filed: Feb. 1, 2021

(65) Prior Publication Data

US 2022/0082333 A1 Mar. 17, 2022

(30) Foreign Application Priority Data

Sep. 15, 2020 (CN) ..... 202010970130.3
Sep. 15, 2020 (CN) ..... 202022012241.1

(51) Int. Cl.
*F28D 15/04* (2006.01)

(52) U.S. Cl.
CPC ..... *F28D 15/04* (2013.01); *F28D 15/046* (2013.01)

(58) Field of Classification Search
CPC .... F28D 15/04; F28D 15/046; F28D 15/0233; H01L 23/427
See application file for complete search history.

(56) References Cited

U.S. PATENT DOCUMENTS 3,754,594 A * 8/1973 Ferrell ..... F28D 15/046 165/272
4,441,548 A * 4/1984 Franklin ..... F28D 15/046 165/104.27
4,674,565 A * 6/1987 Beam ..... F28D 15/046 29/890.032
7,258,160 B2 * 8/2007 Hashimoto ..... F28D 15/0275 165/905
8,590,601 B2 * 11/2013 Lee ..... F28D 15/046 165/104.26
2007/0240855 A1 * 10/2007 Hou ..... F28D 15/046 165/104.26
2007/0240859 A1 * 10/2007 Wang ..... F28D 15/046 165/104.33

(Continued)

FOREIGN PATENT DOCUMENTS

CN 201229139 Y 4/2009
JP 3173270 B2 * 6/2001

(Continued)

*Primary Examiner* — Joel M Attey
*Assistant Examiner* — For K Ling
(74) *Attorney, Agent, or Firm* — Merchant & Gould P.C.

(57) ABSTRACT

A heat pipe including a pipe body, a first capillary structure and a second capillary structure. The pipe body has an evaporation portion and a condensation portion. The condensation portion is connected to the evaporation portion. The first capillary structure is disposed in the evaporation portion. The second capillary structure is disposed in the condensation portion and is connected to an end of the condensation portion that is located away from the evaporation portion. The second capillary structure is not in direct contact with the first capillary structure.

8 Claims, 7 Drawing Sheets

(56) References Cited

U.S. PATENT DOCUMENTS

| | | | | |
|---|---|---|---|---|
| 2009/0084526 | A1* | 4/2009 | Chang | F28D 15/046 165/104.26 |
| 2012/0227934 | A1* | 9/2012 | Huang | F28D 15/046 29/890.032 |
| 2013/0092354 | A1* | 4/2013 | Semenov | F28D 15/04 165/104.26 |
| 2013/0174966 | A1* | 7/2013 | He | B22F 7/002 156/89.11 |
| 2014/0305616 | A1* | 10/2014 | Jang | F28D 15/046 165/104.26 |
| 2015/0060021 | A1* | 3/2015 | Chauhan | F28D 15/046 29/890.032 |
| 2016/0014931 | A1* | 1/2016 | Hamakawa | H05K 7/20336 165/104.26 |
| 2020/0248970 | A1* | 8/2020 | Chen | F28D 15/046 |

FOREIGN PATENT DOCUMENTS

| | | | | |
|---|---|---|---|---|
| JP | 2005114179 | * | 4/2005 | F28D 15/02 |
| WO | WO-2020018484 A1 | * | 1/2020 | F28D 15/046 |

* cited by examiner

HEAT PIPE WITH COMPOSITE WICK STRUCTURE

CROSS-REFERENCE TO RELATED APPLICATIONS

This non-provisional application claims priority under 35 U.S.C. § 119(a) on Patent Application No(s). 202022012241.1 filed in China, on Sep. 15, 2020, and on Patent Application No(s). 202010970130.3 filed in China, on Sep. 15, 2020, the entire contents of which are hereby incorporated by reference.

TECHNICAL FIELD

The disclosure relates to a thermally conductive component, more particularly to a heat pipe.

BACKGROUND

Heat pipe is a hollow pipe made of metal material and effectively transfers heat between two solid interfaces. The heat pipe can be used in various applications, such as the aerospace field, and recently is widely used as a heat exchanger or a cooler for civil use.

The heat pipe has a sealed chamber for working fluid. The heat pipe employs phase change of the working fluid flowing between the vaporization and condensation ends of the heat pipe to transfer thermal energy. At the evaporation end of the heat pipe, the liquid working fluid is vaporized and then travels to the condensation end due to the pressure difference. The working fluid is condensed into liquid and then flows back to the evaporation end via a capillary structure.

In practical use, the heat source in contact with the evaporation portion may be turned off, and thus the temperature difference between the condensation portion and the evaporation portion may be reduced to about 30° C. This will lead to a reduction of the pressure difference between the condensation portion and the evaporation portion, thus causing the working fluid in the condensation portion to rapidly flow back to the evaporation end through the capillary structure before being cooled to the desired temperature. As a result, the heat dissipation efficiency of the heat pipe will be reduced. Thus, it is desired to find a solution to prevent the working fluid in the condensation portion from rapidly flowing back to the evaporation end via the capillary structure before it is cooled to the desired temperature during the down-time of the heat source.

SUMMARY

The disclosure provides a heat pipe that is capable of preventing the working fluid in the condensation portion from rapidly flowing back to the evaporation portion via the capillary structure before it is cooled to the desired temperature.

One embodiment of this disclosure provides a heat pipe including a pipe body, a first capillary structure and a second capillary structure. The pipe body has an evaporation portion and a condensation portion. The condensation portion is connected to the evaporation portion. The first capillary structure is disposed in the evaporation portion. The second capillary structure is disposed in the condensation portion and is connected to an end of the condensation portion that is located away from the evaporation portion. The second capillary structure is not in direct contact with the first capillary structure.

Another embodiment of this disclosure provides a heat pipe including a pipe body and a first capillary structure. The pipe body has an evaporation portion and a condensation portion. The condensation portion is connected to the evaporation portion. An extension direction of the evaporation portion is substantially perpendicular to an extension direction of the condensation portion so that a bent portion is formed between the condensation portion and the evaporation portion. The first capillary structure is disposed in the evaporation portion and spaced apart from the condensation portion.

According to the heat pipe disclosed by the above embodiments, the second capillary structure is thermally coupled to the first capillary structure through the pipe body and is not in direct contact with the first capillary structure. Also, there is no another capillary structure between the second capillary structure and the first capillary structure. Thus, the working fluid in the second capillary structure is prevented from directly flowing to the first capillary structure and the working fluid in the first capillary structure is prevented from directly flowing to the second capillary structure. As a result, when the heat source that is in contact with the evaporation portion is turned off, the working fluid in the condensation portion is prevented from rapidly flowing towards the evaporation portion before it is cooled to the desired temperature due to the space between the second capillary structure and condensation sidewall and the space between the second capillary structure and the first capillary structure.

Additionally, when the heat source that is in contact with the evaporation portion is turned off, the working fluid in the condensation portion is prevented from rapidly flowing towards the evaporation portion before it is cooled to the desired temperature since the first capillary structure is not disposed in the condensation portion and there is no additional capillary structure in the condensation portion.

BRIEF DESCRIPTION OF THE DRAWINGS

The present disclosure will become better understood from the detailed description given herein below and the accompanying drawings which are given by way of illustration only and thus are not intending to limit the present disclosure and wherein.

DETAILED DESCRIPTION

Figure 1:
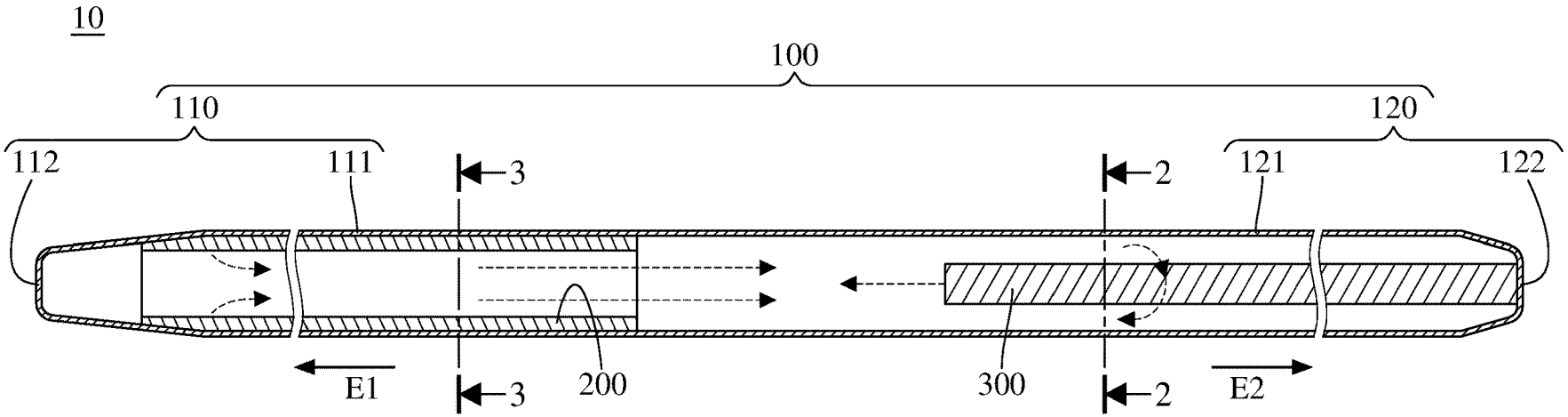
FIG. 1 is a cross-sectional view of a heat pipe according to a first embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
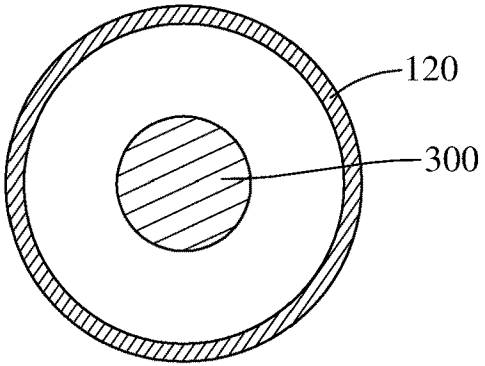
FIG. 2 is a cross-sectional view taken along line 2-2 in FIG. 1.
Figure 3:
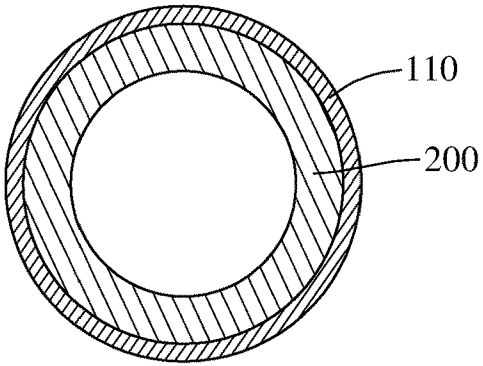
FIG. 3 is a cross-sectional view taken along line 3-3 in FIG. 1.

Please refer to FIG. 1 to FIG. 3, where FIG. 1 is a cross-sectional view of a heat pipe 10 according to a first embodiment of the disclosure, FIG. 2 is a cross-sectional view taken along line 2-2 in FIG. 1, and FIG. 3 is a cross-sectional view taken along line 3-3 in FIG. 1.

In this embodiment, the heat pipe 10 includes a pipe body 100, a first capillary structure 200 and a second capillary structure 300. The pipe body 100 is made of, for example, a thermally conductive material, such as gold, silver, copper and aluminum. The pipe body 100 has an evaporation portion 110 and a condensation portion 120. The condensation portion 120 is connected to the evaporation portion 110, and an extension direction E1 of the evaporation portion 110 is parallel to an extension direction E2 of the condensation portion 120. The evaporation portion 110 is configured to be thermally coupled to a heat source (not shown), such as a central processing unit (CPU) or graphics processing unit (GPU), to absorb the heat generated by the heat source. The condensation portion 120 is configured to be thermally coupled to a heat dissipation fin (not shown) configured for dissipating the heat outside.

In this embodiment, the evaporation portion 110 includes an evaporation sidewall 111 and an evaporation end wall 112, and the condensation portion 120 includes a condensation sidewall 121 and a condensation end wall 122. The evaporation sidewall 111 is connected to the condensation sidewall 121. The evaporation end wall 112 is the closed end of the evaporation portion 110, the condensation end wall 122 is the closed end of the evaporation portion 110, and the evaporation sidewall 111 and the condensation sidewall 121 are connected to each other and located between the evaporation end wall 112 and the condensation end wall 122 so that the evaporation portion 110 and the condensation portion 120 together form a sealed chamber.

The first capillary structure 200 is disposed in the evaporation portion 110 and is in a ring shape. In this embodiment, the first capillary structure 200 is stacked on the evaporation sidewall 111 of the evaporation portion 110 and is in the form of having, for example, a mesh structure, sintered powder structure or sintered ceramic structure, but the disclosure is not limited thereto. In other embodiments, the first capillary structure may be formed on the evaporation sidewall and in the form of having a micro-groove structure.

Additionally, in this embodiment, the first capillary structure 200 and the evaporation end wall 112 are spaced apart from each other, but the disclosure is not limited thereto. In other embodiments, the first capillary structure may be connected to the evaporation end wall. In this embodiment, the first capillary structure 200 and the condensation portion 120 are spaced apart from each other, but the disclosure is not limited thereto. In other embodiments, the first capillary structure may be stacked on the evaporation portion and the condensation portion, which is described in later paragraphs.

The second capillary structure 300 is disposed in the condensation portion 120 and is in a cylindrical shape, but the disclosure is not limited thereto. In other embodiments, the second capillary structure may be in a ring shape or in other suitable shapes, such as a pillar shape or closed shape. In this embodiment, one end of the second capillary structure 300 is fixed to the condensation end wall 122 via, for example, welding, and the second capillary structure 300 is spaced apart from the condensation sidewall 121. The second capillary structure 300 is in direct contact with the condensation end wall 122, which means that the second capillary structure 300 is in contact with the condensation end wall 122 with or without an intermediate component therebetween, where the intermediate component is a material for fixing the second capillary structure 300 to the condensation end wall 122, such as an adhesive or a solder. The second capillary structure 300 is not in direct contact with the condensation sidewall 121, which means that the second capillary structure 300 is spaced apart from the condensation sidewall 121 and has no direct physical contact with the condensation sidewall 121. In this arrangement, the second capillary structure 300 transfers heat to the condensation portion 120 mainly through the condensation end wall 122. In this embodiment, the second capillary structure 300 is in the form of having, for example, a mesh structure, sintered powder structure or sintered ceramic structure.

In addition, the second capillary structure 300 is spaced apart from the first capillary structure 200, which means that the second capillary structure 300 and the first capillary structure 200 have no direct physical contact with each other. In this or other embodiments, the second capillary structure 300 and the first capillary structure 200 may be spaced apart from each other by air, insulation material or thermally conductive material.

As discussed, in this embodiment, the second capillary structure 300 is thermally connected to the first capillary structure 200 via the condensation end wall 122, the condensation sidewall 121 and the evaporation sidewall 111, although the second capillary structure 300 and the first capillary structure 200 are spaced apart from each other. That is, in this embodiment, the second capillary structure 300 is thermally coupled to the first capillary structure 200 through the pipe body 100, and thus there is no capillary structure between the second capillary structure 300 and the first capillary structure 200, preventing the working fluid in the second capillary structure 300 from directly flowing to the first capillary structure 200 and preventing the working fluid in the first capillary structure 200 from directly flowing to the second capillary structure 300.

As a result, when the heat source that is in contact with the evaporation portion 110 is turned off, the working fluid in the condensation portion 120 is prevented from rapidly flowing towards the evaporation portion 110 before it is cooled to the desired temperature due to the space between the second capillary structure 300 and first capillary structure 200.

In this embodiment, the second capillary structure 300 only has a mesh structure, a sintered powder structure or a sintered ceramic structure, but the disclosure is not limited thereto. In other embodiments, the second capillary structure may be a composite capillary structures. For example, in other embodiments, the second capillary structure may include two parts that are stacked on each other, where the two parts of the second capillary structure are in different forms. In such an embodiment, one part of the second capillary structure may have a mesh structure and the other part of the second capillary structure may have a sintered powder structure.

The dotted arrow in FIG. 1 indicates the flowing direction of the working fluid that is in the form of liquid or vapor. Hereinafter, the operation of the heat pipe is explained by referring to FIG. 1. After the working fluid is vaporized in the evaporation portion 110, the working fluid that is in the form of vapor moves to the condensation portion 120 due to the pressure difference and is then condensed into liquid, where at least part of the liquid working fluid flows back to the evaporation portion 110 via the gap between the second capillary structure 300 and the condensation sidewall 121. It is to be explained that, in this embodiment, part of the liquid working fluid may flow back to the evaporation portion 110 further via the second capillary structure 300.

Figure 4:
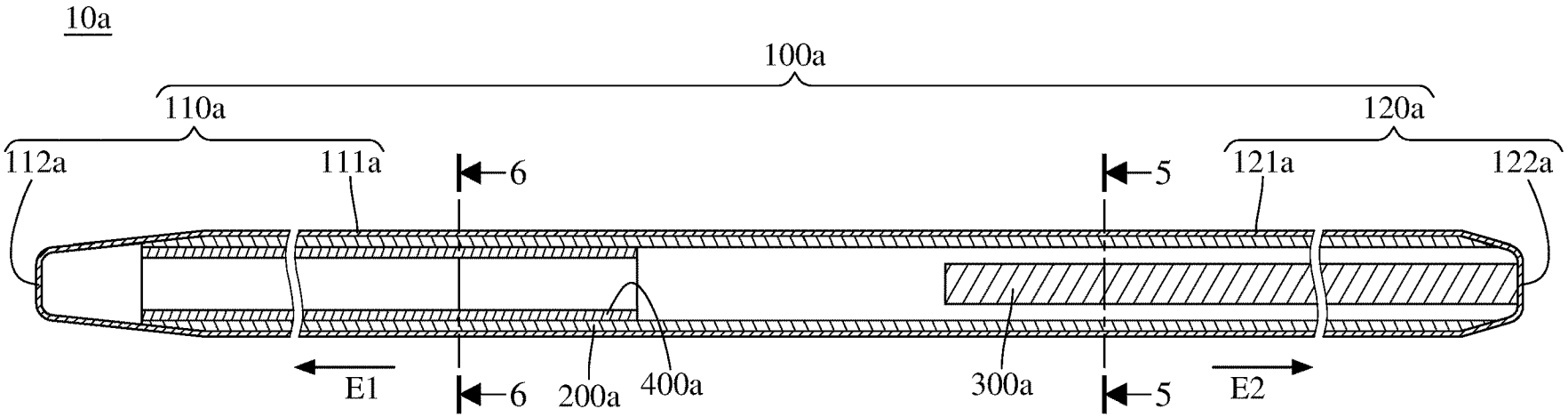
FIG. 4 is a cross-sectional view of a heat pipe according to a second embodiment of the disclosure.
Figure 6:
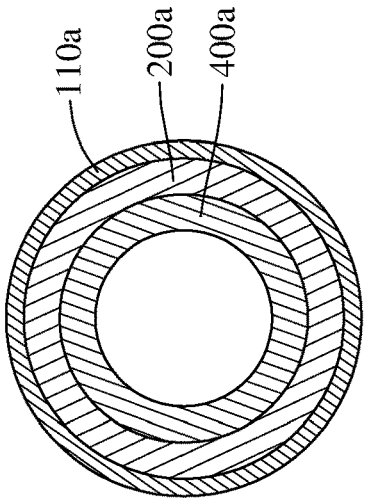
FIG. 6 is a cross-sectional view taken along line 6-6 in FIG. 4.
Figure 5:
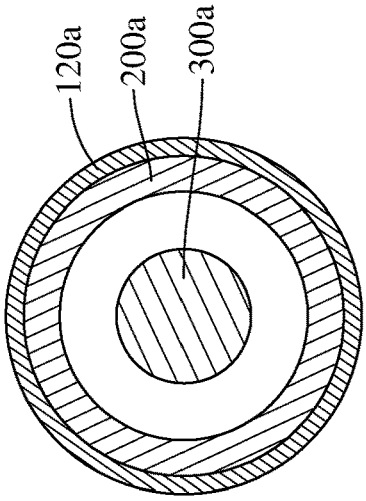
FIG. 5 is a cross-sectional view taken along line 5-5 in FIG. 4.

Please refer to FIG. 4 to FIG. 6, where FIG. 4 is a cross-sectional view of a heat pipe 10*a* according to a second embodiment of the disclosure, FIG. 5 is a cross-sectional view taken along line 5-5 in FIG. 4, and FIG. 6 is a cross-sectional view taken along line 6-6 in FIG. 4. The heat pipe 10*a* in FIG. 4 is similar to the heat pipe 10 in FIG. 1, and the main difference therebetween is the configuration of the capillary structures, and thus at least some of the repeated descriptions are omitted hereinafter In this embodiment, the heat pipe 10*a* includes a pipe body 100*a*, a first capillary structure 200*a*, a second capillary structure 300*a* and a third capillary structure 400*a*. The pipe body 100*a* is made of, for example, a thermally conductive material, such as gold, silver, copper and aluminum. The pipe body 100*a* has an evaporation portion 110*a* and a condensation portion 120*a*. The condensation portion 120*a* is connected to the evaporation portion 110*a*, and an extension direction E1 of the evaporation portion 110*a* is parallel to an extension direction E2 of the condensation portion 120*a*. The evaporation portion 110*a* is configured to be thermally coupled to a heat source (not shown), such as a central processing unit (CPU) or graphics processing unit (GPU), to absorb the heat generated by the heat source. The condensation portion 120*a* is configured to be thermally coupled to a heat dissipation fin (not shown) configured for dissipating the heat outside.

In this embodiment, the evaporation portion 110*a* includes an evaporation sidewall 111*a* and an evaporation end wall 112*a*, and the condensation portion 120*a* includes a condensation sidewall 121*a* and a condensation end wall 122*a*. The evaporation sidewall 111*a* is connected to the condensation sidewall 121*a*. The evaporation end wall 112*a* is the closed end of the evaporation portion 110*a*, and the condensation end wall 122*a* is the closed end of the condensation portion 120*a*, and the evaporation sidewall 111*a* and the condensation sidewall 121*a* are connected to each other and located between the evaporation end wall 112*a* and the condensation end wall 122*a* so that the evaporation portion 110*a* and the condensation portion 120*a* together form a sealed chamber.

The first capillary structure 200*a* is disposed in the pipe body 100*a* and is in, for example, a ring shape. In addition, the first capillary structure 200*a* extends from the evaporation portion 110*a* into the condensation portion 120*a*. Further, the first capillary structure 200*a* is not only stacked on an inner surface of the evaporation portion 110*a*, but also is stacked on an inner surface of the condensation portion 120*a*.

In this embodiment, the first capillary structure 200*a* is a composite structure. In detail, a part of the first capillary structure 200*a* that is stacked on the condensation portion 120*a* is in the form of having, for example, a mesh structure whose mesh thickness ranging from 0.1 mm to 0.2 mm, and the other part of the first capillary structure 200*a* that is stacked on the evaporation portion 110*a* is in the form of having, for example, a sintered powder structure or a composite structure including a mesh structure and a sintered powder structure. In such a case, the capillary action of the part of the first capillary structure 200*a* that is stacked on the evaporation portion 110*a* is stronger than that of the part of the first capillary structure 200*a* that is stacked on the condensation portion 120*a*. Therefore, although the first capillary structure 200*a* is in direct contact with the condensation portion 120*a*, the working fluid in the condensation portion 120*a* is prevented from rapidly flowing back to the evaporation portion 110*a* before it is cooled to the desired temperature.

In this embodiment, the first capillary structure 200*a* is a composite capillary structure, but the disclosure is not limited thereto. In other embodiments, the first capillary structure may only have a mesh structure, sintered powder structure or sintered ceramic structure. In such an embodiment, a thickness of the part of the first capillary structure 200*a* being stacked on the evaporation portion 110*a* may be larger than a thickness of the part of the first capillary structure 200*a* being stacked on the condensation portion 120*a*.

In addition, in this embodiment, the first capillary structure 200*a* is spaced apart from the evaporation end wall 112*a*, but the disclosure is not limited thereto. In other embodiments, the first capillary structure 200*a* may be arranged to be connected to the evaporation end wall 112*a*.

The second capillary structure 300*a* is disposed in the condensation portion 120*a* and is in a cylindrical shape, but the disclosure is not limited thereto. In other embodiments, the second capillary structure may be in a ring shape. One end of the second capillary structure 300*a* is fixed to the condensation end wall 122*a* via, for example, welding, and the second capillary structure 300*a* is spaced apart from the condensation sidewall 121*a* and the first capillary structure 200*a* stacked on the inner surface of the condensation sidewall 121*a*. The second capillary structure 300*a* is in direct contact with the condensation end wall 122*a*, which means that the second capillary structure 300*a* is in contact with the condensation end wall 122*a* with or without an intermediate component therebetween, where the intermediate component is a material for fixing the second capillary structure 300*a* to the condensation end wall 122*a*, such as an adhesive or a solder. The second capillary structure 300*a* is not in direct contact with the condensation sidewall 121*a* and the first capillary structure 200*a*, which means that the second capillary structure 300*a* has no direct physical contact with the condensation sidewall 121*a*, such as being spaced apart from the condensation sidewall 121*a* by air. In this arrangement, the second capillary structure 300*a* transfers heat to the condensation portion 120*a* mainly through the condensation end wall 122*a*. In this embodiment, the second capillary structure 300*a* is in the form of having, for example, a mesh structure, sintered powder structure or sintered ceramic structure.

In addition, the second capillary structure 300*a* is spaced apart from the first capillary structure 200*a*, which means that the second capillary structure 300*a* and the first capillary structure 200*a* have no direct physical contact with each other. In this or other embodiments, the second capillary structure 300*a* and the first capillary structure 200*a* may be spaced apart from each other by air, insulation material or thermally conductive material.

The third capillary structure 400*a* is stacked on the first capillary structure 200*a* and is spaced apart from the second capillary structure 300*a*, which means the second capillary structure 300*a* and the third capillary structure 400*a* have no direct physical contact with each other. In this or other embodiments, the second capillary structure 300*a* and the third capillary structure 400*a* may be spaced apart from each other by air, insulation material or thermally conductive material. In addition, the third capillary structure 400*a* is in the form of having, for example, a mesh structure, sintered powder structure or sintered ceramic structure In this embodiment, the third capillary structure 400*a* is located in the evaporation portion 110*a* and is not located in the condensation portion 120*a*, but the disclosure is not limited thereto. In other embodiments, the third capillary structure may cover the inner surfaces of the evaporation portion and the condensation portion.

In this embodiment, the second capillary structure 300*a* is thermally coupled to the first capillary structure 200*a* via the condensation end wall 122*a*, the condensation sidewall 121*a* and the evaporation sidewall 111*a*, although the second capillary structure 300*a* and the first capillary structure 200*a* are spaced apart from each other. That is, in this embodiment, the second capillary structure 300*a* is thermally coupled to the first capillary structure 200*a* via the pipe body 100*a*, and thus there is no capillary structure between the second capillary structure 300*a* and the first capillary structure 200*a*, preventing the working fluid in the second capillary structure 300*a* from directly flowing to the first capillary structure 200*a* and preventing the working fluid in the first capillary structure 200*a* from directly flowing to the second capillary structure 300*a*.

As a result, when the heat source that is in contact with the evaporation portion 110*a* is turned off, the working fluid in the condensation portion 120*a* is prevented from rapidly flowing towards the evaporation portion 110*a* before it is cooled to the desired temperature due to the space between the second capillary structure 300*a* and condensation sidewall 121*a* and the spaces between the second capillary structure 300*a* and the first and third capillary structures 200*a* and 400*a*.

In this embodiment, the second capillary structure 300*a* only has a mesh structure, a sintered powder structure or a sintered ceramic structure, but the disclosure is not limited thereto. In other embodiments, the second capillary structure may be a composite capillary structures. For example, in other embodiments, the second capillary structure may include two parts that are stacked on each other, where the two parts of the second capillary structure are in different forms. In such an embodiment, one part of the second capillary structure may have a mesh structure and the other part of the second capillary structure may have a sintered powder structure.

Figure 7:
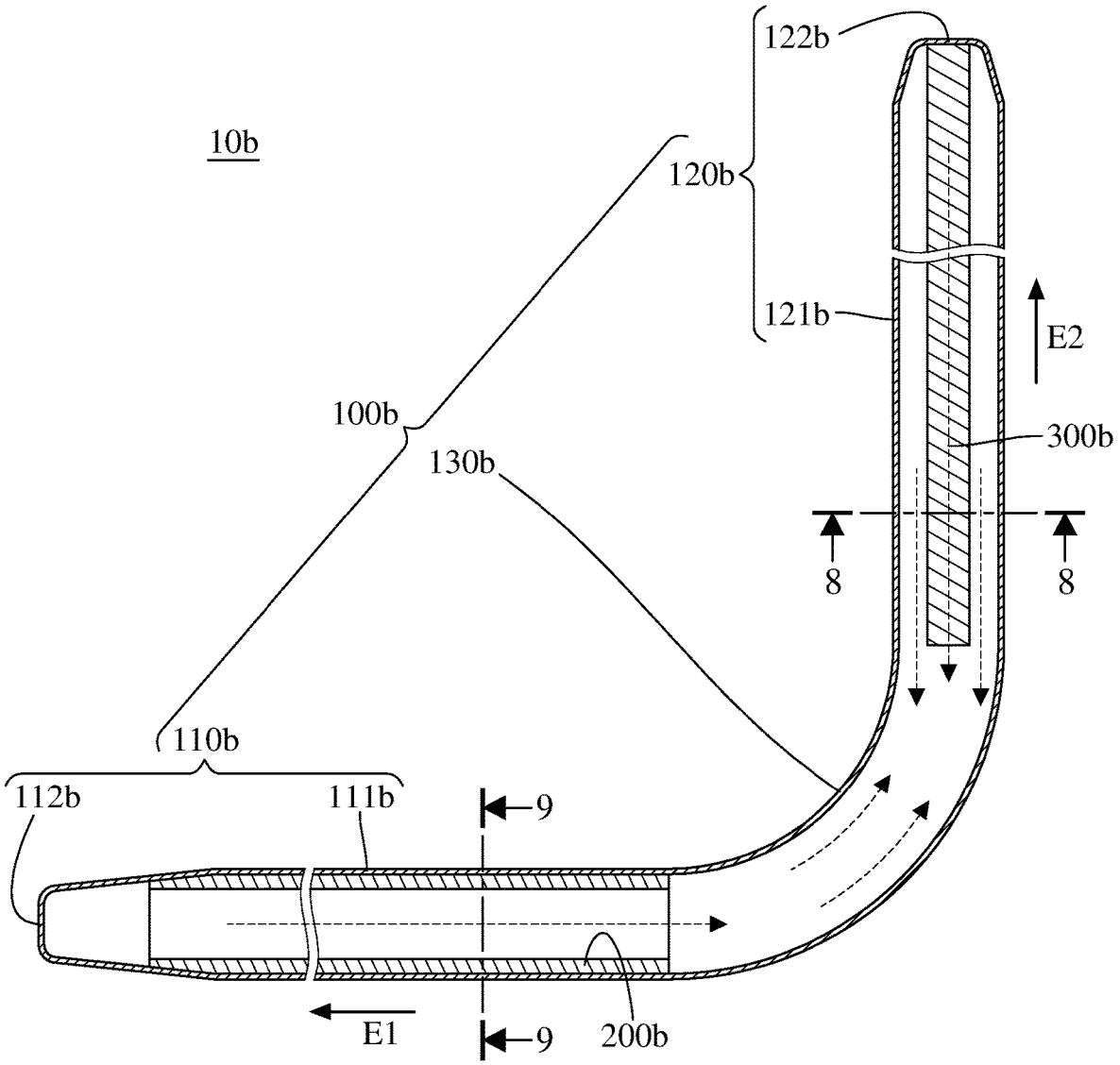
FIG. 7 is a cross-sectional view of a heat pipe according to a third embodiment of the disclosure.
Figure 8:
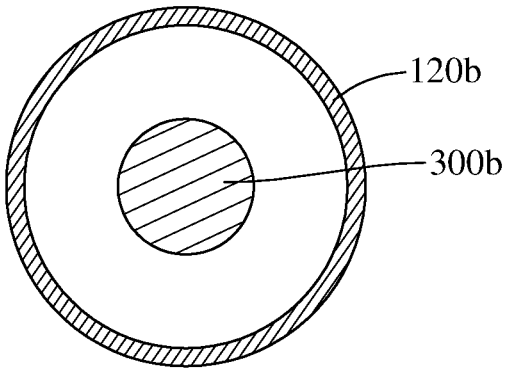
FIG. 8 is a cross-sectional view taken along line 8-8 in FIG. 7.
Figure 9:
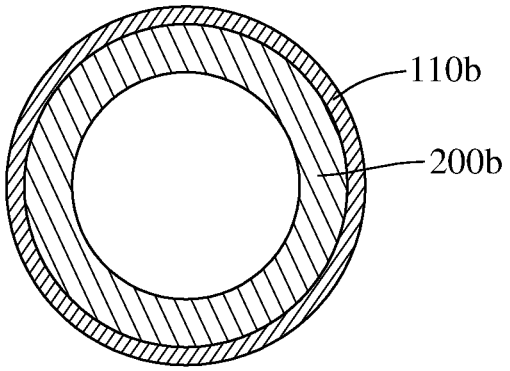
FIG. 9 is a cross-sectional view taken along line 9-9 in FIG. 7.

Please refer to FIG. 7 to FIG. 9, where FIG. 7 is a cross-sectional view of a heat pipe according to a third embodiment of the disclosure, FIG. 8 is a cross-sectional view taken along line 8-8 in FIG. 7, and FIG. 9 is a cross-sectional view taken along line 9-9 in FIG. 7. The heat pipe in FIG. 7 is similar to the heat pipe 10 in FIG. 1, and the main difference therebetween is the configuration of the pipe body, and thus at least some of the repeated descriptions are omitted hereinafter In this embodiment, a heat pipe 10*b* includes a pipe body 100*b*, a first capillary structure 200*b* and a second capillary structure 300*b*. The pipe body 100*b* is made of, for example, a thermally conductive material, such as gold, silver, copper and aluminum. The pipe body 100*b* has an evaporation portion 110*b* and a condensation portion 120*b*. An extension direction E1 of the evaporation portion 110*b* is substantially perpendicular to an extension direction E2 of the condensation portion 120*b*, and the evaporation portion 110*b* and the condensation portion 120*b* are connected to each other via a bent portion 130*b*. More specifically, the extension direction E1 of the evaporation portion 110*b* and the extension direction E2 of the condensation portion 120*b* may be perpendicular to each other or nearly perpendicular to each other due to the manufacture tolerance. The evaporation portion 110*b* is configured to be thermally coupled to a heat source (not shown), such as a central processing unit (CPU) or graphics processing unit (GPU), to absorb the heat generated by the heat source. The condensation portion 120*b* is configured to be thermally coupled to a heat dissipation fin (not shown) configured for dissipating the heat outside.

In this embodiment, the evaporation portion 110*b* includes an evaporation sidewall 111*b* and an evaporation end wall 112*b*, and the condensation portion 120*b* includes a condensation sidewall 121*b* and a condensation end wall 122*b*. The evaporation sidewall 111*b* and the condensation sidewall 121*b* are respectively connected to two opposite ends of the bent portion 130*b*. The evaporation end wall 112*b* is the closed end of the evaporation portion 110*b*, and the condensation end wall 122*b* is the closed end of the condensation portion 120*b*, and the evaporation sidewall 111*b* and the condensation sidewall 121*b* are connected to each other via the bent portion 130*b* and located between the evaporation end wall 112*b* and the condensation end wall 122*b* so that the evaporation portion 110*b*, the bent portion 130*b* and the condensation portion 120*b* together form a sealed chamber.

The first capillary structure 200*b* is disposed in the evaporation portion 110*b* and is in, for example, a ring shape. In addition, the first capillary structure 200*b* is stacked on an inner surface of the evaporation sidewall 111*b* of the evaporation portion 110*b*. In this embodiment, the first capillary structure 200*b* is in the form of having, a mesh structure, but the disclosure is not limited thereto. In other embodiments, the first capillary structure may be in the form of a micro groove and formed on the evaporation sidewall.

Furthermore, in this embodiment, the first capillary structure 200*b* is spaced apart from the evaporation end wall 112*b*, but the disclosure is not limited thereto. In other embodiments, the first capillary structure may be in direct contact with the evaporation end wall 112*b*. In this embodiment, the first capillary structure 200*b* is located in the evaporation portion 110*b*, but the disclosure is not limited thereto. In other embodiments, the first capillary structure may be located in the evaporation portion and the condensation portion.

The second capillary structure 300*b* is disposed in the condensation portion 120*b* and is in a cylindrical shape, but the disclosure is not limited thereto. In other embodiments, the second capillary structure may be in a ring shape. One end of the second capillary structure 300*b* is fixed to the condensation end wall 122*b* via, for example, welding, and the second capillary structure 300*b* is spaced apart from the condensation sidewall 121*b*. The second capillary structure 300*b* is in direct contact with the condensation end wall 122*b*, which means that the second capillary structure 300*b* is in contact with the condensation end wall 122*b* with or without an intermediate component therebetween, where the intermediate component is a material for fixing the second capillary structure 300*b* to the condensation end wall 122*b*, such as an adhesive or a solder. The second capillary structure 300*b* is not in direct contact with the condensation sidewall 121*b*, which means that the second capillary structure 300*b* has no direct physical contact with the condensation sidewall 121*b*, such as being spaced apart from the condensation sidewall 121*b* by air. In this arrangement, the second capillary structure 300*b* transfers heat to the condensation portion 120*b* mainly through the condensation end wall 122*b*. In this embodiment, the second capillary structure 300*b* is in the form of having, for example, a mesh structure, sintered powder structure or sintered ceramic structure.

In addition, the second capillary structure 300*b* is spaced apart from the first capillary structure 200*b*, which means that the second capillary structure 300*b* and the first capillary structure 200*b* have no direct physical contact with each other. In this or other embodiments, the second capillary structure 300*b* and the first capillary structure 200*b* may be spaced apart from each other by air, insulation material or thermally conductive material.

In this embodiment, the second capillary structure 300*b* is thermally coupled to the first capillary structure 200*b* via the condensation end wall 122*b*, condensation sidewall 121*b* and the evaporation sidewall 111*b*, although the second capillary structure 300*b* and the first capillary structure 200*b* are spaced apart from each other. That is, in this embodiment, the second capillary structure 300*b* is thermally coupled to the first capillary structure 200*b* via the pipe body 100*b* and thus there is no capillary structure between the second capillary structure 300*b* and the first capillary structure 200*b*, preventing the working fluid in the second capillary structure 300*b* from directly flowing to the first capillary structure 200*b* and preventing the working fluid in the first capillary structure 200*b* from directly flowing to the second capillary structure 300*b*.

As a result, when the heat source that is in contact with the evaporation portion 110*b* is turned off, the working fluid in the condensation portion 120*b* is prevented from rapidly flowing towards the evaporation portion 110*b* before it is cooled to the desired temperature due to the space between the second capillary structure 300*b* and condensation sidewall 121*b* and the space between the second capillary structure 300*b* and the first capillary structure 200*b*.

In this embodiment, the second capillary structure 300*b* only has a mesh structure, a sintered powder structure or a sintered ceramic structure, but the disclosure is not limited thereto. In other embodiments, the second capillary structure may be a composite capillary structures. For example, in other embodiments, the second capillary structure may include two parts that are stacked on each other, where the two parts of the second capillary structure are in different forms. In such an embodiment, one part of the second capillary structure may have a mesh structure and the other part of the second capillary structure may have a sintered powder structure.

The dotted arrow in FIG. 7 indicates the flowing direction of the working fluid that is in the form of liquid or vapor. Hereinafter, the operation of the heat pipe is explained by referring to FIG. 7. After the working fluid is vaporized in the evaporation portion 110*b*, the working fluid that is in the form of vapor moves to the condensation portion 120*b* due to the pressure difference and is then condensed into liquid, where at least part of the liquid working fluid flows back to the evaporation portion 110*b* via the gap between the second capillary structure 300*b* and the condensation sidewall 121*b*. It is to be explained that, in this embodiment, part of the liquid working fluid may flow back to the evaporation portion 110*b* further via the second capillary structure 300*b*.

Figure 10:
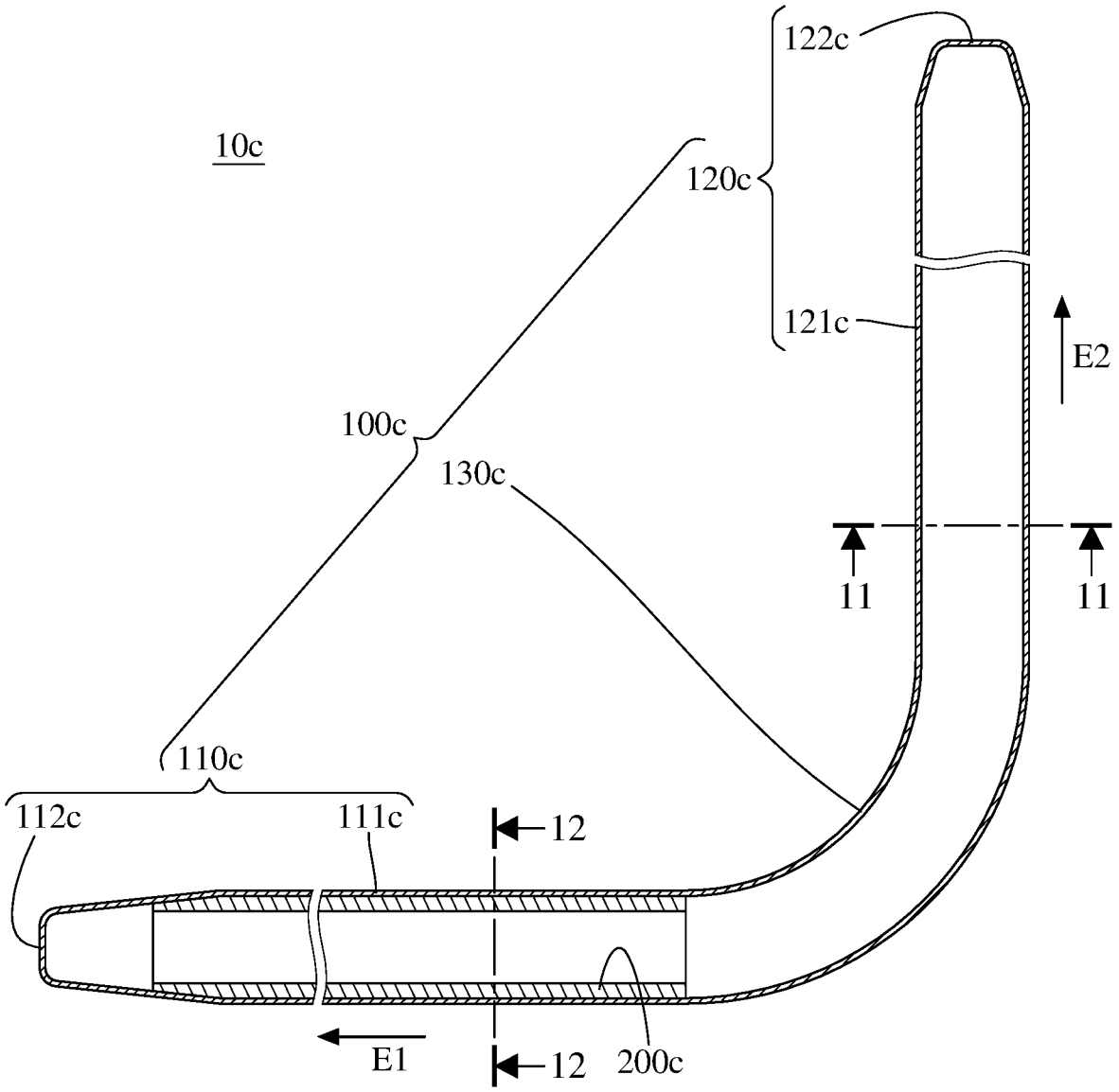
FIG. 10 is a cross-sectional view of a heat pipe according to a fourth embodiment of the disclosure.
Figure 11:
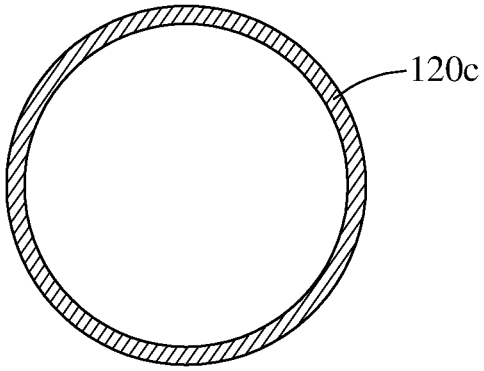
FIG. 11 is a cross-sectional view taken along line 11-11 in FIG. 10.
Figure 12:
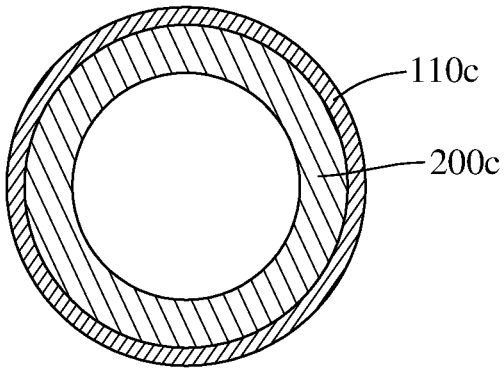
FIG. 12 is a cross-sectional view taken along line 12-12 in FIG. 10.

Please refer to FIG. 10 to FIG. 12, where FIG. 10 is a cross-sectional view of a heat pipe according to a fourth embodiment of the disclosure, FIG. 11 is a cross-sectional view taken along line 11-11 in FIG. 10, and FIG. 12 is a cross-sectional view taken along line 12-12 in FIG. 10. The heat pipe in FIG. 10 is similar to the heat pipe in FIG. 7, and the main difference therebetween is the configuration of the capillary structure, and thus at least some of the repeated descriptions are omitted hereinafter In this embodiment, a heat pipe 10*c* includes a pipe body 100*c* and a first capillary structure 200*c*. The pipe body 100*c* is made of, for example, a thermally conductive material, such as gold, silver, copper and aluminum. The pipe body 100*c* has an evaporation portion 110*c* and a condensation portion 120*c*. An extension direction E1 of the evaporation portion 110*c* is substantially perpendicular to an extension direction E2 of the condensation portion 120*c*, and the evaporation portion 110*c* and the condensation portion 120*c* are connected to each other via a bent portion 130*c*. More specifically, the extension direction E1 of the evaporation portion 110*c* and the extension direction E2 of the condensation portion 120*c* may be perpendicular to each other or nearly perpendicular to each other due to the manufacture tolerance. The evaporation portion 110*c* is configured to be thermally coupled to a heat source (not shown), such as a central processing unit (CPU) or graphics processing unit (GPU), to absorb the heat generated by the heat source. The condensation portion 120*c* is configured to be thermally coupled to a heat dissipation fin (not shown) configured for dissipating the heat outside.

In this embodiment, the evaporation portion 110*c* includes an evaporation sidewall 111*c* and an evaporation end wall 112*c*, and the condensation portion 120*c* includes a condensation sidewall 121*c* and a condensation end wall 122*c*. The evaporation end wall 112*c* is the closed end of the evaporation portion 110*c*, the condensation end wall 122*c* is the closed end of the evaporation portion 110*c*, and the evaporation sidewall 111*c* and the condensation sidewall 121*c* are connected to each other and located between the evaporation end wall 112*c* and the condensation end wall 122*c* so that the evaporation portion 110*c* and the condensation portion 120*c* together form a sealed chamber.

The first capillary structure 200*c* is disposed in the evaporation portion 110*c* and is in a ring shape. In this embodiment, the first capillary structure 200*c* is stacked on the evaporation sidewall 111*c* of the evaporation portion 110*c* and is in the form of having, for example, a mesh structure, sintered powder structure or sintered ceramic structure, but the disclosure is not limited thereto. In other embodiments, the first capillary structure may be formed on the evaporation sidewall and in the form of having a micro-groove structure.

Additionally, in this embodiment, the first capillary structure 200*c* and the evaporation end wall 112*c* are spaced apart from each other, but the disclosure is not limited thereto. In other embodiments, the first capillary structure may be connected to the evaporation end wall. In this embodiment, the first capillary structure 200*c* is located in the evaporation portion 110*c*, and that is, the first capillary structure 200*c* is spaced apart from the bent portion 130*c* and the condensation portion 120*c*, but the disclosure is not limited thereto. In other embodiments, the first capillary structure may be located in the evaporation portion and the bent portion.

In this embodiment, the first capillary structure 200*c* is not located in the condensation portion 120*c*, and as shown, there is no additional capillary structure disposed in the condensation portion 120*c*. Thus, although heat can be transferred between the condensation portion 120*c* and the first capillary structure 200*c*, the working fluid in the capillary structure disposed in the condensation portion 120*c* still is prevented from directly flowing to the first capillary structure 200*c* and the working fluid in the first capillary structure 200*c* is prevented from directly flowing to the capillary structure disposed in the condensation portion 120*c*.

Therefore, when the heat source that is in contact with the evaporation portion 110*c* is turned off, the working fluid in the condensation portion 120*c* is prevented from rapidly flowing towards the evaporation portion 110*c* before it is cooled to the desired temperature since the first capillary structure 200*c* is not disposed in the condensation portion 120*c* and there is no additional capillary structure in the condensation portion 120*c*. In this embodiment, during the operation of the heat pipe 10*c*, the condensation portion 120*c* may be placed in a vertical manner so that the gravity can force the working fluid in the condensation portion 120*c* to flow back to the evaporation portion 110*c*.

Figure 13:
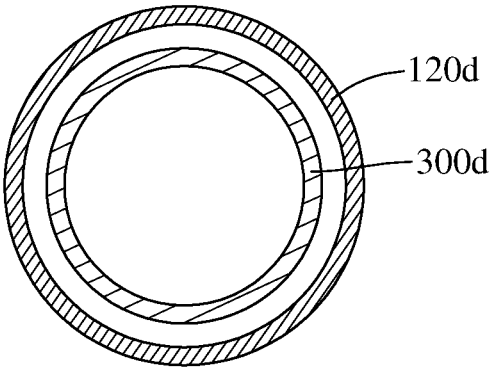
FIG. 13 is a cross-sectional view of a condensation end of a heat pipe according to a fifth embodiment of the disclosure.

The second capillary structure 300 in the embodiment shown in FIG. 1 is in a cylindrical shape, but the disclosure is not limited thereto. Please refer to FIG. 13, there is shown a cross-sectional view of a condensation end of a heat pipe according to a fifth embodiment of the disclosure. The heat pipe in FIG. 13 is similar to the heat pipe 10 in FIG. 1, and the main difference therebetween is the configuration of the second capillary structure, and thus at least some of the repeated descriptions are omitted hereinafter. In this embodiment, a second capillary structure 300*d* is disposed in the condensation portion 120*d* and is in a ring shape. In this embodiment, only one end of the second capillary structure 300*d* is fixed to the condensation portion 120*d*. The second capillary structure 300*d* is spaced apart from a circumferential wall of the condensation portion 120*d*, but the disclosure is not limited thereto. In other embodiments, the second capillary structure may be in contact with the condensation portion and an area of a contact surface of the second capillary structure where the condensation portion is in contact may be small relative to an overall surface area of the second capillary structure. In this embodiment, the second capillary structure 300*d* is in the form of having, for example, a mesh structure, sintered powder structure or sintered ceramic structure.

In addition, in this embodiment, similar to the second capillary structure 300 in the embodiment shown in FIG. 1, the second capillary structure 300*d* is not in direct contact with the first capillary structure 200*d*, and thus the repeated descriptions thereof are not repeated.

Figure 14:
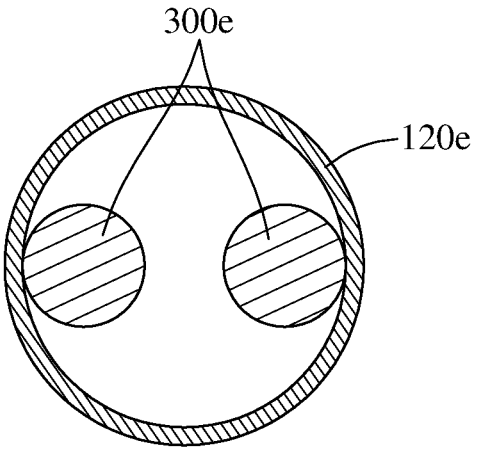
FIG. 14 is a cross-sectional view of a condensation end of a heat pipe according to a sixth embodiment of the disclosure.

The second capillary structure 300 in the embodiment shown in FIG. 1 is in a cylindrical shape and is single, but the disclosure is not limited thereto. Please refer to FIG. 14, there is shown a cross-sectional view of a condensation end of a heat pipe according to a sixth embodiment of the disclosure. The heat pipe in FIG. 14 is similar to the heat pipe 10 in FIG. 1, and the main difference therebetween is the configuration of the second capillary structure, and thus at least some of the repeated descriptions are omitted hereinafter. In this embodiment, there are two second capillary structures 300*e*. The two second capillary structures 300*e* are disposed in the condensation portion 120*e* and are in a cylindrical shape. In this embodiment, only one end of each second capillary structure 300*e* is fixed to the condensation portion 120*e*. The two second capillary structures 300*e* are in partial contact with the circumferential wall of the condensation portion 120*e*. An area of a contact surface of each second capillary structure 300*e* where the condensation portion is in contact is small relative to an overall surface area of the second capillary structure 300*e*. For example, the area of the contact surface of each second capillary structure is smaller than ten percent of the overall surface area of an outer circumferential surface of the second capillary structure 300*e*. In other embodiments, the second capillary structure may be spaced apart from the circumferential wall of the condensation portion. In this embodiment, each second capillary structure 300*e* is in the form of having, for example, a mesh structure, sintered powder structure or sintered ceramic structure.

In addition, in this embodiment, the two second capillary structures 300*e* are spaced apart from each other, but the disclosure is not limited thereto. In other embodiments, the two second capillary structures may be connected to each other.

Moreover, in this embodiment, like the second capillary structure 300 in the embodiment shown in FIG. 1, the second capillary structure 300*e* is not in direct contact with the first capillary structure 200*e*, and thus the detail descriptions thereof are not repeated.

Figure 15:
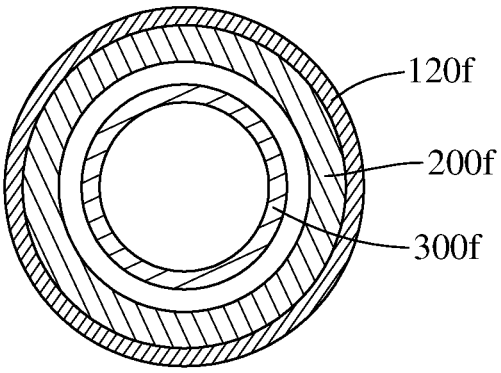
FIG. 15 is a cross-sectional view of a condensation end of a heat pipe according to a seventh embodiment of the disclosure.

The second capillary structure 300 in the embodiment shown in FIG. 2 is in a cylindrical shape, but the disclosure is not limited thereto. Please refer to FIG. 15, there is shown a cross-sectional view of a condensation end of a heat pipe according to a seventh embodiment of the disclosure. The heat pipe in FIG. 15 is similar to the heat pipe 10 in FIG. 2, and the main difference therebetween is the configuration of the second capillary structure, and thus at least some of the repeated descriptions are omitted hereinafter. In this embodiment, the second capillary structure 300*f* is disposed in the condensation portion 120*f* and is in a ring shape. In this embodiment, only one end of the second capillary structure 300*f* is fixed to the condensation portion 120*f*. The second capillary structure 300*f* is spaced apart from a circumferential wall of the condensation portion 120*f*. In this embodiment, the second capillary structure 300*f* is in the form of having, for example, a mesh structure, sintered powder structure or sintered ceramic structure.

In addition, in this embodiment, similar to the second capillary structure 300 in the embodiment shown in FIG. 2, the second capillary structure 300*f* is not in direct contact with the first capillary structure 200*f*, and thus the repeated descriptions thereof are not repeated.

Figure 16:
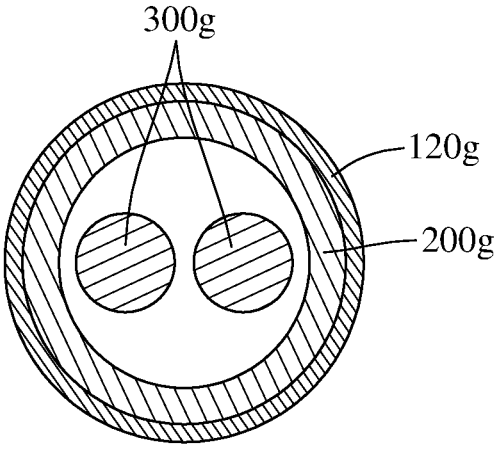
FIG. 16 is a cross-sectional view of a condensation end of a heat pipe according to an eighth embodiment of the disclosure.

The second capillary structure 300*a* in the embodiment shown in FIG. is in a cylindrical shape and is single, but the disclosure is not limited thereto. Please refer to FIG. 16, there is shown a cross-sectional view of a condensation end of a heat pipe according to an eighth embodiment of the disclosure. The heat pipe in FIG. 16 is similar to the heat pipe 10*a* in FIGS. 4 to 6, and the main difference therebetween is the configuration of the second capillary structure, and thus at least some of the repeated descriptions are omitted hereinafter. In this embodiment, there are two second capillary structures 300*g*. The two second capillary structures 300*g* are disposed in the condensation portion 120*g* and are in a cylindrical shape. In this embodiment, only one end of each second capillary structure 300*g* is fixed to condensation portion 120*g*. The two second capillary structures 300*g* are not in direct contact with the circumferential wall of the condensation portion 120*g* and the first capillary structure 200*g*. In this embodiment, each second capillary structure 300*g* is in the form of having, for example, a mesh structure, sintered powder structure or sintered ceramic structure.

In addition, in this embodiment, the two second capillary structures 300*g* are spaced apart from each other, but the disclosure is not limited thereto. In other embodiments, the two second capillary structures may be connected to each other.

Moreover, in this embodiment, like the second capillary structure 300*a* in the embodiment shown in FIG., the second capillary structure 300*g* is not in direct contact with the first capillary structure 200*g*, and thus the detail descriptions thereof are not repeated.

According to the heat pipe disclosed by the above embodiments, the second capillary structure is thermally coupled to the first capillary structure through the pipe body and is not in direct contact with the first capillary structure. Also, there is no another capillary structure between the second capillary structure and the first capillary structure. Thus, the working fluid in the second capillary structure is prevented from directly flowing to the first capillary structure and the working fluid in the first capillary structure is prevented from directly flowing to the second capillary structure. As a result, when the heat source that is in contact with the evaporation portion is turned off, the working fluid in the condensation portion is prevented from rapidly flowing towards the evaporation portion before it is cooled to the desired temperature due to the space between the second capillary structure and condensation sidewall and the space between the second capillary structure and the first capillary structure.

Additionally, when the heat source that is in contact with the evaporation portion is turned off, the working fluid in the condensation portion is prevented from rapidly flowing towards the evaporation portion before it is cooled to the desired temperature since the first capillary structure is not disposed in the condensation portion and there is no additional capillary structure in the condensation portion.

It will be apparent to those skilled in the art that various modifications and variations can be made to the present disclosure. It is intended that the specification and examples be considered as exemplary embodiments only, with a scope of the disclosure being indicated by the following claims and their equivalents.

What is claimed is:

1. A heat pipe, comprising:

a pipe body having an evaporation portion and a condensation portion that are arranged along an axial direction of the pipe body so that the evaporation portion is connected to the condensation portion, the evaporation portion includes an evaporation end wall, an evaporation sidewall, and a transition portion that connects the evaporation end wall and the evaporation sidewall;

a first wick that is disposed in the pipe body having an inner surface and that extends along the axial direction of the pipe body from the evaporation portion into the condensation portion, the first wick being spaced apart from the evaporation end wall and partially disposed in the transition portion;

a second wick that is disposed in the condensation portion and that extends along the axial direction of the pipe body from an end of the condensation portion that is located away from the evaporation portion towards the evaporation portion so that the second wick overlaps with the first wick in the axial direction, but is not in direct contact therewith; and a third wick disposed in the evaporation portion, that extends along the inner surface of the first wick in the axial direction of the pipe body towards the condensation portion, but does not overlap with the second wick in the axial direction.

2. The heat pipe according to claim 1, wherein the condensation portion comprises a condensation sidewall and a condensation end wall, the condensation sidewall is connected to the evaporation portion, the condensation end wall is connected to a side of the condensation sidewall that is located away from the evaporation portion, and the second wick is in direct contact with the condensation end wall and is not in direct contact with the condensation sidewall.

3. The heat pipe according to claim 2, wherein the first wick is in direct contact with the evaporation sidewall.

4. The heat pipe according to claim 3, wherein the first wick is further in direct contact with the condensation sidewall.

5. The heat pipe according to claim 2, wherein the third wick is stacked on the first wick and is not in direct contact with the second wick.

6. The heat pipe according to claim 5, wherein the heat pipe comprises two second wicks, and the two second wicks are spaced apart from each other.

7. The heat pipe according to claim 5, wherein the heat pipe comprises two second wicks, and the two second wicks are connected to each other.

8. The heat pipe according to claim 1, wherein the second wick and the first wick are connected not via another wick.

* * * * *